United States Patent [19]

Rotolico et al.

[11] 4,333,416

[45] Jun. 8, 1982

[54] EXTENSION NOZZLE ATTACHMENT FOR A FLAME-SPRAY TORCH

[75] Inventors: Anthony J. Rotolico, Hauppauge; Eduardo Romero, Coram, both of N.Y.

[73] Assignee: Eutectic Corporation, Flushing, N.Y.

[21] Appl. No.: 140,142

[22] Filed: Apr. 14, 1980

[51] Int. Cl.[3] ..... B05C 5/04; B05C 7/02; B05C 7/06

[52] U.S. Cl. ..... 118/47; 118/306; 239/85

[58] Field of Search ..... 118/47, 302, 306; 239/79, 85

[56] References Cited

U.S. PATENT DOCUMENTS

| | | | |
|---|---|---|---|
| 2,643,955 | 6/1953 | Powers et al. | 118/47 X |
| 2,842,095 | 7/1958 | Leibner | 118/306 |
| 3,085,750 | 4/1963 | Kenshol | 239/79 X |
| 3,171,599 | 3/1965 | Rotolico | 239/85 |
| 3,344,992 | 10/1967 | Norris | 239/79 X |
| 3,436,019 | 4/1969 | Hawk, Sr. . | |

*Primary Examiner*—John P. McIntosh

*Attorney, Agent, or Firm*—Hopgood, Calimafde, Kalil, Blaustein & Judlowe

[57] ABSTRACT

The invention contemplates an elongate extension nozzle attachment for a gas torch whereby flame-spraying of coating-powder material may be applied with precision to the bore of a workpiece. The attachment is detachably securable to conventional torch and/or gas-distributor structure and provides independent flows of (a) carrier gas and powder and (b) combustible-gas mixture to a nozzle which is removably fitted to the discharge end. Provision is made for optional use of one or more flame-shaping discharges of air, inert gas or the like at the discharge end, using a further independent supply system within the attachment.

12 Claims, 2 Drawing Figures

EXTENSION NOZZLE ATTACHMENT FOR A FLAME-SPRAY TORCH

BACKGROUND OF THE INVENTION

The invention relates to structure for supporting and supplying a flame-spray nozzle of a gas torch for powder-coating operations in the bore of a workpiece.

Conventional gas-torch nozzles are removably fitted to the discharge end of a gas distributor, forming an integral or a connected part of the torch per se. The powder to be flame-sprayed is conventionally applied to external surfaces, such as a path along a flat surface, or in a cove near juncture of intersecting surfaces, or to a convex cylindrical surface (which may be lathe-rotated), or to a semi-cylindrical or otherwise arcuate concave surface. But we are unaware of any accessory attachment or device whereby precise flame-sprayed coatings may be applied in an elongate workpiece bore, particularly a bore of such small diameter as to preclude torch-body entry, support, and control within the bore.

BRIEF STATEMENT OF THE INVENTION

It is an object of the invention to provide an improved flame-spraying gas-torch structure to enable precise coating and/or heat-treating by flame action in a bore of the character indicated.

A specific object is to meet the above objects with structure in which all nozzle support and supply components are contained within a single elongate tubular body.

Another specific object is to provide such structure with a uniformly high incidence angle of flame-spray action upon a workpiece bore surface, the angle being consistently high, regardless of the depth to which the nozzle is entered in the bore.

A further specific object is to provide for selectively directional flame-shaping gas discharge in conjunction with nozzle-support and supply structure of the character indicated.

A general object is to meet the above objects with basically simple structure which lends itself to ready servicing and maintenance, and which is detachably securable to conventional powder-spraying torch apparatus.

The foregoing and other objects and features are achieved in a tubular extension which is detachably securable to conventional torch and/or gas-distributor structure and which provides independent flows of (a) carrier gas and powder and (b) combustible-gas mixture, to a nozzle which is removably fitted to the discharge end. Provision is made for optional concurrent use of one or more flame-shaping (accelerating) discharges of air, inert gas or the like at the discharge end, using a further independent supply system within the attachment.

DETAILED DESCRIPTION

Figures 1, 2:
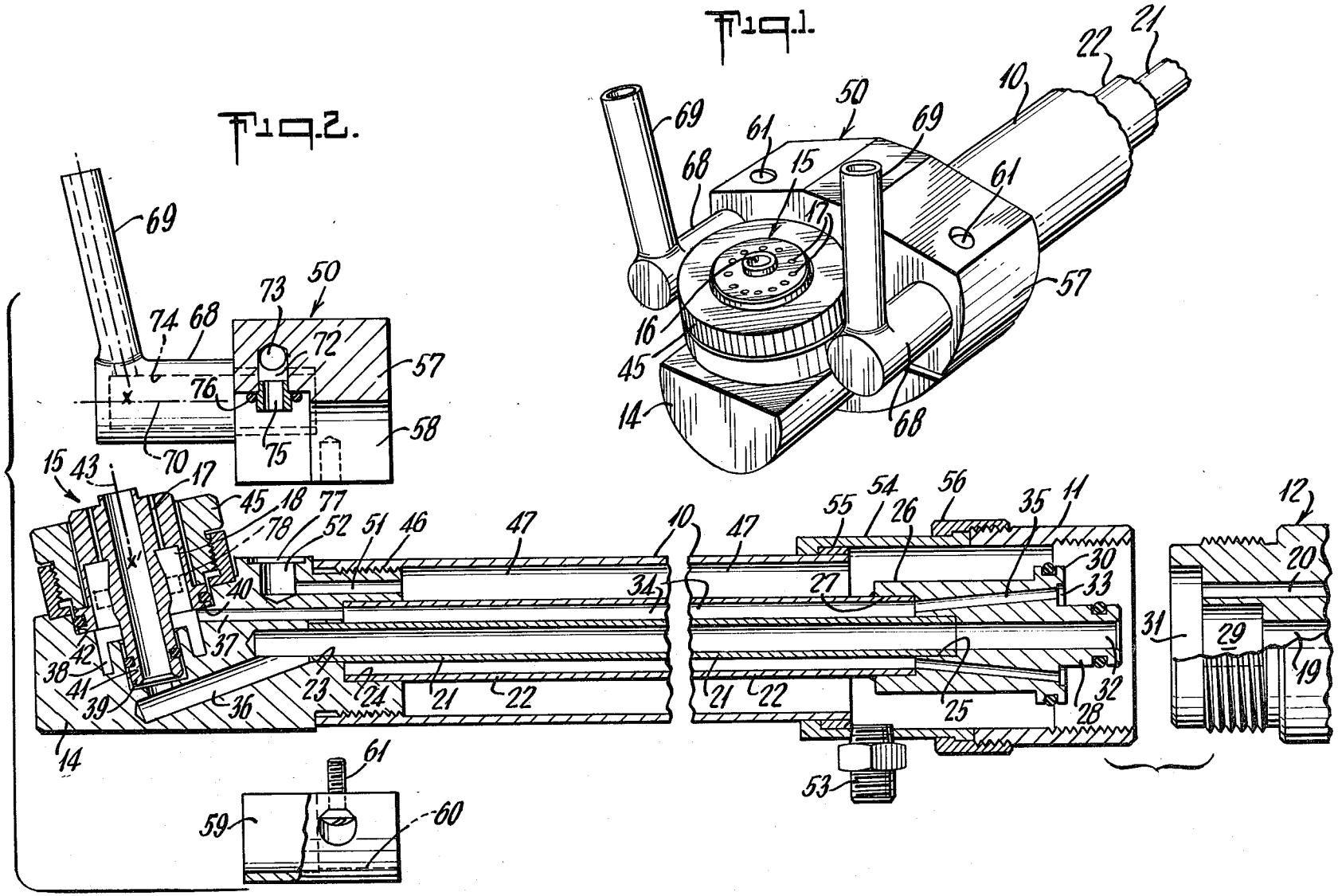

An illustrative embodiment of the invention will be described in detail, in conjunction with the accompanying drawings, in which:

FIG. 1 is a fragmentary longitudinal sectional view of a gas-torch extension attachment of the invention, shown in exploded relation with related structure; and FIG. 2 is a fragmentary view in perspective to show the relation of cooperating parts at the nozzle end of the attachment of FIG. 1.

The attachment shown comprises an elongate cylindrical body 10, with threaded coupling means 11 at its upstream and for removable attachment to a conventional torch component such as a gas distributor 12, and with a head 14 at its downstream end for removable connection of a nozzle insert fitting 15. The nozzle fitting 15 has a central through-passage 16 along its axis for axial discharge of a flow of carrier gas and powder material to be flame-sprayed, and an annular array of spaced jets 17 is served by an annular manifold 18, for distribution of combustible-gas mixture, such as oxygen and acetylene, to establish a base of the spraying flame surrounding the powder discharge. Independent supplies of (a) carrier gas and powder and (b) combustible-gas mixture are available from distributor 12, via a central passage 19 and via a plurality of angularly spaced outer passages 20, respectively. The independence of these supplies is maintained throughout the elongate body 10, up to the point of their respective head-end connections to nozzle passage 16 and to manifold 18.

In the form shown, independence of the indicated flows is achieved via concentric elongate inner and outer tubes 21–22. At its downstream end, tube 21 has a permanent press-fit to an inner counterbore 23 in head 14, and tube 22 is permanently fitted to an outer counterbore 24, with preferably a soldered seal of the fit. Similarly, at its upstream end, the inner tube 21 has a permanent press-fit to an inner counterbore 25 at the downstream end of a generally cylindrical gas-connector bushing 26, while the outer tube 22 has a preferably soldered connection at its fit to an outer counterbore 27. Gas-tight removable connection is made to distributor 12 via telescoping reception of a tubular bushing projection 28 in an inner counterbore 29, and via similar reception of a seal flange 30 in an outer counterbore 31. Peripheral grooves in projection 28 and in flange 30 locate elastomeric O-rings for sealing the two telescoping relationships; the central bore 32 of bushing 26 is smoothly continuous with the bore of tube 21, and a short annular manifold groove 33 in the end face of flange 30 provides adapting connection from the mixture passages 20 of the distributor, to the elongate annular passage 34 (between tubes 21–22) via connecting bushing passages 35.

At the head end, an internal passage 36 connects the bore of inner tube 21 to nozzle passage 16, and a plurality of smaller-diameter passages, as at 37, connects the annular passage 34 to a combustible-mixture manifolding region 38 of head 14.

The nozzle fitting 15 may be conventional and of the type which would otherwise and conventionally be removably attachable to the described end of distributor 12, with O-ring sealed fit of its projecting end 39 in the inner counterbore 29, and similarly sealed fit of its outer flange 40 to the outer counterbore 31. It is thus similarly fitted at the downstream end of the extension, at suitable head (14) bore formations. For bore-coating purposes, however, it is preferred that nozzle-discharge be at relatively high incidence to the workpiece surface being coated, and therefore the inner and outer bore surfaces 41–42 which telescopically receive the nozzle regions 39–40 are on an axis 43 which is at a large acute angle to the elongation axis of body 10. As shown, an internally threaded ring 44, brazed or soldered to head 14, coacts with threads of a flanged ring 45 to clamp the nozzle-insert fitting 15 in its installed position, wherein the manifold formations 18–38 of the fitted parts provide relatively large-volume combustible-mixture service of the jet passages 17.

Description of the basic extension attachment of FIG. 1 is completed by identifying threads 46 by which the outer tubular casing or body 10 is removably secured to body 14, in spaced concentric relation to the tubes 21–22, thus defining a third elongate passage, in the annular space 47. This space 47 accommodates a flow of air, inert or other gas for flame-shaping purposes to a module 50, to be later described, the supply being via an independent head passage 51 to a radially outward module-connection port 52. At the upstream end, the passage 47 receives its supply of air or other gas via a hose nipple 53 through the shell of a coupling member 54 having an internal flange to engage a locating flange or ring 55 forming part of body 10. A union nut 56 has flanged coaction with member 54 and secures the connection to distributor 12 via threads of coupling means 11.

The flame-shaping module 50 comprises a distributor body 57 having a generally semi-cylindrical concave seat formation 58 conforming to the outer-surface curvature of the extension body 10. A U-shaped clamp or strap member 59 has a similar generally semi-cylindrical concave seat formation 60, and diametrically spaced bolts 61 removably secure the clamped relation of module 50 and strap 59 to the downstream end of body 10, with axial overlap of port 52. As shown, the distributor body 57 straddles the cylindrical upstream end of head 14 and provides almost diametrically opposite mounting bores for the reduced end of each of two jet-conduit bodies 68. Each of the bodies 68 has an elongate tubular jet arm 69; the rotational adjustment axis 70 of each of the bodies 68 in the distributor body 57 is parallel to the elongation of body 10, and the discharge orientation of each jet arm 69 is preferably at the large acute angle which characterizes the angularly offset orientation of nozzle axis 43. Individual set screws 71 enable the jet arms 69 to be clamped in parallel relation to the nozzle axis 43, or at any other desired relation thereto; preferably, when parallel to nozzle axis 43, the discharge axes of jet arms 69 are in an inclined geometric plane that includes axis 43.

It will be understood that the distributor body 57 has an inlet passage 72 for distributed supply of incoming air, inert or other flame-shaping gas to the two jet arms 69, via connected internal passages 73 (in distributor body 57) and 74 (in jet-conduit bodies 68). A sealed connection of this supply at port 52 is provided by a bushing 75, press-fitted to the inlet passage 72 and projecting to an extent sufficiently to retain and seat an elastomeric O-ring 76. When the module 50 is assembled to the extension attachment, the projecting end of bushing 75 provides a means of location to the bore of port 52; and, upon take-up of the clamp bolts 61, the O-ring 76 is compressed in sealed and seated engagement with a counterbore 77 at the outer end of port 52.

The described extension attachment will be seen to achieve all stated objects with simplicity, effectiveness and convenience. The overall length of the extension is no source of inconvenience, and high-quality coatings may be applied to a workpiece bore, regardless of the depth which the extension must reach in order to make the coating. For extreme lengths, the distributor 12 is conveniently mounted to a slide on elongate ways which are parallel to the extension axis, whereby the nozzle and its extension may be accurately traversed along the workpiece bore, reliance being placed, for example, upon the clamp strap or other fitting at 59, as a guide shoe for accurately piloted local support of the head 14 in the workpiece bore.

While the invention has been described in detail for a preferred form, it will be understood that modifications may be made without departing from the scope of the invention. For example, for situations in which relatively large gas flows are needed for high-heat spraying of particular powder materials, the nozzle insert 15 may incorporate a press-fitted annular baffle ring (suggested by phantom outline 78) fitted to a cylindrical land of nozzle stem 39 at an axially intermediate region of the manifold cavity 18 of insert 15, in the manner more fully described in copending patent application Ser. No. 219,226 filed Dec. 23, 1980, for prevention of flame-disabling flash-back in the combustible-mixture supply line. Also, the invention will be seen to be applicable to continuous spray-coated treatment of the elongate bore of a lathe-rotated tubular workpiece, traverse action being with lathe precision when the torch and its nozzle extension of the invention are mounted to the main slide or carriage of the lathe.

What is claimed is:

1. As an article of manufacture, a nozzle attachment for a flame-spray torch for coating within a workpiece bore, said attachment comprising an elongate body with means at one end for removable gas-distributor connection to a gas torch and with a head at the other end for removable nozzle connection, said head having nozzle-mounting means on a nozzle-orienting axis at angular offset with respect to the elongation of said body, first and second independent elongate concentric passages extending the length of said body to said head first for accommodation of a distributor-supplied flow of carrier gas and powder and second for accommodation of a distributor-supplied flow of combustible-gas mixture; a nozzle removably fitted to said head on said offset axis and having a central passage for discharge of carrier gas and powder on the nozzle axis, said nozzle having an angularly spaced plurality of combustible-gas jets concentrically arrayed about the nozzle axis and radially outside said central passage, said head and nozzle having cooperating formations defining an annular-manifold region for supply of said combustible-gas jets, said head having first passage means establishing an independent connection of said first elongate passage to the central passage of said nozzle, and said head having second passage means establishing an independent connection of said second elongate passage to said manifold region; the gas-distributor connection means at said one end including cylindrical formations concentric with said passages, and means on said body for selectively securing said one end to a gas distributor in any desired angular orientation of said offset axis with respect to the axis of concentricity of said formations.

2. The article of claim 1, in which the external surface of said body is cylindrical about the concentric axis of said passages and the nozzle axis intersects the cylindrical axis of said body.

3. The article of claim 2, in which said body is radially spaced from said passages to determine a third elongate independent passage extending from said one end to said head for accommodation of a flow of flame-shaping gas, flame-shaping discharge-jet means carried by said head radially outside the locus of combustible gas-jet array, said flame-shaping discharge-jet means being directionally oriented generally parallel to the nozzle axis, and said head having third passage means establishing an independent connection of said third elongate passage to said flame-shaping discharge-jet means.

4. The article of claim 3, in which said flame-shaping discharge-jet means comprises a module with means for removably attaching the same to the head end of said body, said third passage means including detachably sealed connection between said head and said module.

5. The article of claim 4, in which said detachably sealed connection includes an elastomeric O-ring and opposed O-ring engaging compression surfaces on said head and module, the means for removable attachment of said module comprising a clamp for compressing said O-ring engaging surfaces against the O-ring.

6. The article of claim 4, in which said module includes a plurality of flame-shaping discharge jets at angular offset from each other about the nozzle axis.

7. The article of claim 6, in which each of said flame-shaping discharge jets includes a jet-discharge tube and a generally cylindrical mounting body therefor, said tube being at angular offset from said mounting body, each said mounting body being supported by said module for rotation about the cylindrical axis of said mounting body, and said module having selectively operable means for retaining a selected one of a plurality of angular orientations of each mounting body.

8. The article of claim 1, in which the upstream end of said first passage means is characterized by an inner axial bore in said head and in which the upstream end of said second passage means is characterized by another axial counterbore in said head, and concentric radially spaced elongate tubular members respectively seated in said bore and counterbore and establishing said first elongate passage within the inner tubular member and establishing said second elongate passage in the annular space between said tubular members.

9. The article of claim 8, in which said gas-distributor connection means comprises a generally cylindrical bushing having a central axial passage with counterbore means concentrically supporting the upstream ends of said tubular members, the inner tubular member communicating only with said central axial passage, and said bushing having an angularly spaced plurality of combustible-gas passages communicating with the space between said tubular members.

10. The article of claim 9, in which the upstream end of said bushing has a central tubular axial projection for sealed telescoping fit of said projection in a central distributor bore for delivery of carrier gas and powder, said angularly spaced plurality of combustible-gas passages having upstream ends which are radially outside said tubular projection.

11. The article of claim 10, in which said bushing has a first circumferential O-ring groove on the outer surface of said tubular projection and a second circumferential O-ring groove on a cylindrical outer surface portion which is radially outside the upstream ends of said combustible-gas passages.

12. The article of claim 1, in which the head end of said body includes work-contacting guide means for piloting support of said head end within the bore of a workpiece.

* * * * *